US007192364B2

(12) United States Patent
Long

(10) Patent No.: US 7,192,364 B2
(45) Date of Patent: Mar. 20, 2007

(54) GOLF CLUB HEAD WITH A STIFFENING PLATE

(75) Inventor: Dabbs Clayton Long, Carlsbad, CA (US)

(73) Assignee: Plus 2 International, Inc., Carlsbad, CA (US)

( * ) Notice: Subject to any disclaimer, the term of this patent is extended or adjusted under 35 U.S.C. 154(b) by 106 days.

(21) Appl. No.: 10/855,075

(22) Filed: May 27, 2004

(65) Prior Publication Data

US 2005/0009624 A1 Jan. 13, 2005

Related U.S. Application Data

(60) Provisional application No. 60/567,129, filed on Apr. 30, 2004, provisional application No. 60/473,505, filed on May 27, 2003.

(51) Int. Cl.
*A63B 53/04* (2006.01)

(52) U.S. Cl. ..... 473/329; 473/342; 473/350; 473/345; 473/346

(58) Field of Classification Search ..... 473/324–350
See application file for complete search history.

(56) References Cited

U.S. PATENT DOCUMENTS 4,429,879 A * 2/1984 Schmidt ..... 473/346
4,984,800 A * 1/1991 Hamada ..... 473/346
5,163,682 A 11/1992 Schmidt et al.
5,318,300 A 6/1994 Schmidt et al.
5,467,983 A * 11/1995 Chen ..... 473/342
5,474,296 A 12/1995 Schmidt et al.
5,482,282 A 1/1996 Willis
5,586,947 A * 12/1996 Hutin ..... 473/324
5,669,829 A * 9/1997 Lin ..... 473/346
5,718,645 A * 2/1998 Chang ..... 473/342
5,863,261 A * 1/1999 Eggiman ..... 473/329
5,873,795 A * 2/1999 Wozny et al. ..... 473/350
5,954,596 A 9/1999 Noble et al.
5,993,331 A * 11/1999 Shieh ..... 473/342
6,074,309 A * 6/2000 Mahaffey ..... 473/342
6,165,081 A * 12/2000 Chou ..... 473/329
6,299,547 B1 * 10/2001 Kosmatka ..... 473/329
6,354,962 B1 * 3/2002 Galloway et al. ..... 473/342
6,368,234 B1 4/2002 Galloway
6,398,666 B1 6/2002 Evans et al.
6,413,169 B1 7/2002 Kosmatka
6,428,426 B1 8/2002 Helmstetter et al.
6,454,664 B1 9/2002 Long et al.
6,458,043 B1 10/2002 McCabe et al.
6,471,603 B1 10/2002 Kosmatka
6,478,693 B2 11/2002 Matsunaga et al.
6,491,592 B2 * 12/2002 Cackett et al. ..... 473/342
6,508,722 B1 1/2003 McCabe et al.
6,558,272 B2 5/2003 Helmstetter et al.
6,569,033 B2 5/2003 Kosmatka
6,595,869 B2 7/2003 McCabe et al.
6,605,007 B1 8/2003 Bissonnette et al.
6,672,975 B1 * 1/2004 Galloway ..... 473/342
6,695,715 B1 * 2/2004 Chikaraishi ..... 473/329
6,758,763 B2 * 7/2004 Murphy et al. ..... 473/342
6,800,038 B2 * 10/2004 Willett et al. ..... 473/329

(Continued)

*Primary Examiner*—Sebastiano Passaniti
(74) *Attorney, Agent, or Firm*—Fay Sharpe LLP

(57) ABSTRACT

A golf club head comprises a sole, a crown, and a face plate. A secondary plate attaches to a rear side of the face plate.

22 Claims, 2 Drawing Sheets

U.S. PATENT DOCUMENTS

| | | | | |
|---|---|---|---|---|
| 6,824,475 | B2 * | 11/2004 | Burnett et al. | 473/329 |
| 6,997,820 | B2 * | 2/2006 | Willett et al. | 473/329 |
| 7,066,832 | B2 * | 6/2006 | Willett et al. | 473/329 |
| 7,118,493 | B2 * | 10/2006 | Galloway | 473/329 |
| 2002/0065146 | A1 | 5/2002 | Kusumoto | |
| 2002/0082117 | A1 | 6/2002 | Nishitani et al. | |
| 2002/0165040 | A1 * | 11/2002 | Kosmatka et al. | 473/332 |
| 2003/0078113 | A1 | 4/2003 | Rice | |
| 2003/0083148 | A1 | 5/2003 | Willett et al. | |
| 2003/0092505 | A1 | 5/2003 | Liou | |
| 2003/0157995 | A1 * | 8/2003 | Mahaffey | 473/342 |
| 2006/0154741 | A1 * | 7/2006 | Shieh | 473/342 |

* cited by examiner

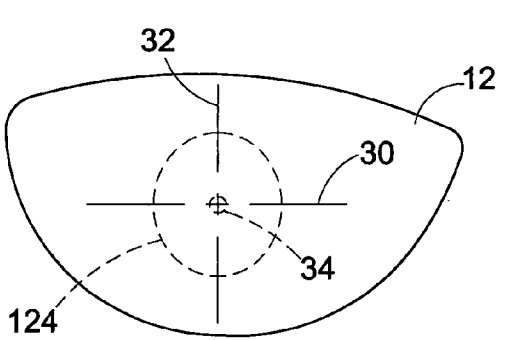
FIG. 9
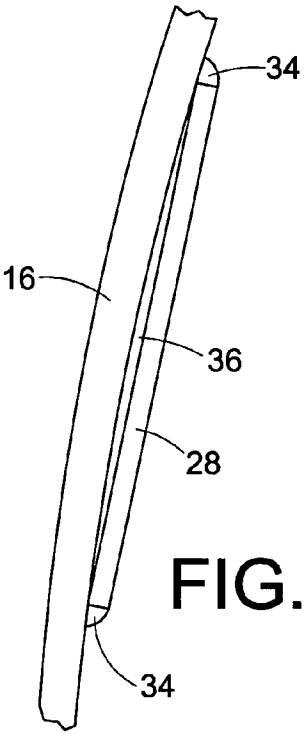
FIG. 7
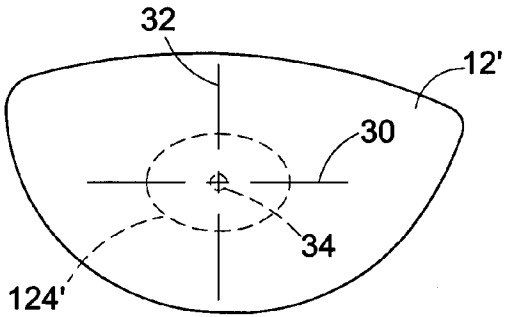
FIG. 10
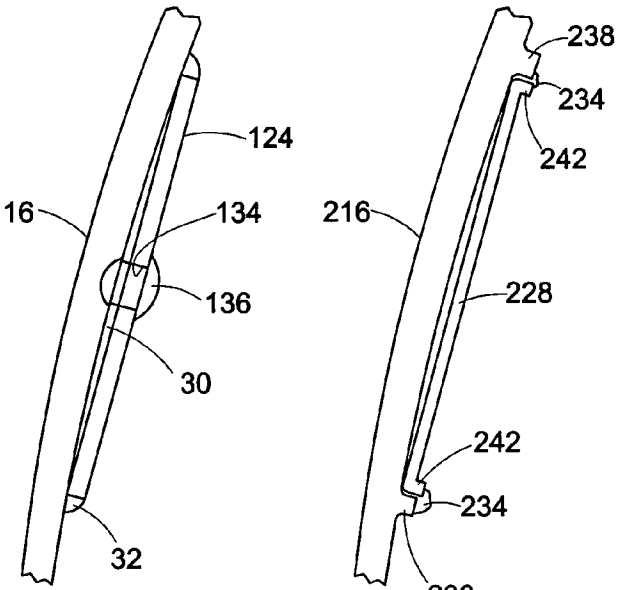
FIG. 12
FIG. 11
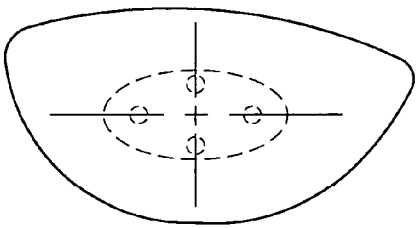
FIG. 14
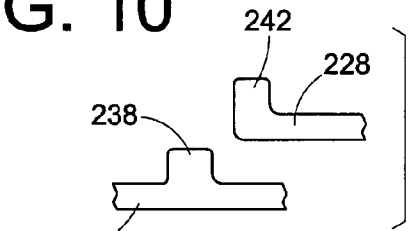
FIG. 13
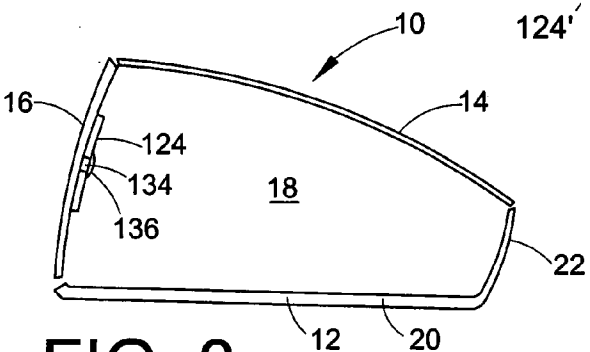
FIG. 8

GOLF CLUB HEAD WITH A STIFFENING PLATE

This application claims priority to and the benefit of U.S. Provisional Application Ser. No. 60/473,505 filed May 27, 2003 entitled "Golf Club Head with a Bracing Plate," and Application Ser. No. 60/567,129 filed Apr. 30, 2004 entitled "Golf Club Head with a Bracing Plate" which are both incorporated herein by reference.

BACKGROUND OF THE INVENTION

The invention relates to golf clubs. More particularly, the invention relates to golf clubs having an internal brace that effects the United States Golf Association ("USGA") coefficient of restitution ("COR") conformity of a wood-type golf club.

A golf club head typically has a face plate that deforms when the face plate strikes the ball. Behaving like a spring, the face plate rebounds to give the ball a higher launch velocity, which is known as the "trampoline effect." Higher face plate deflection can be realized by using a thin face plate with materials that have low rigidity and high strength. Materials that have these properties include titanium, stainless steel and steel alloys and glass or graphite reinforced composite materials.

The rules of golf, established and interpreted by the USGA and The Royal and Ancient Golf Club of Saint Andrews, set forth certain requirements for a golf club head to limit the "trampoline effect." Although the rules of golf do not expressly state specific parameters for a golf club face, the rules prohibit the face from having the effect at impact of a spring with a golf ball. The USGA has adopted a test procedure that measures club face COR. This USGA test procedure, as well as procedures like it, may be used to measure club face COR.

A golf club's COR is determined by the following equation:

$$e=(v_2-v_1)/(U_1-U_2)$$

where $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution ("COR") between the golf ball and the club face. The COR limit is at 0.830 for clubs with less than 15 degree loft for all play in the United States and its territories, therefore, scores may be posted for handicap purposes only when achieved with clubs that satisfy the 0.830 COR limit.

Clubs in the art have limited the deflection of the face plate, thus trying to limit the club's COR, by placing a brace plate behind the face plate. This brace plate is attached to the body of the club head. The face plate deflects until it contacts the brace plate, which physically limits the amount of deflection of the face plate, similar to the bottoming out of a trampoline. These clubs require more material and weight to retard face plate deflection.

Other known devices include attached magnets behind the face plate with nut and bolt assemblies. These devices do not effectively stiffen the face plate and are unnecessarily heavy, upsetting the center of gravity location of the club head.

SUMMARY OF THE INVENTION

A golf club head includes a sole, a crown, a heel, a toe, a skirt and a face plate extending between the sole and the crown and the heel and the toe. A secondary plate attaches to a rear side of the face plate. The secondary plate can include one or more openings.

A method for making a golf club head is also provided. The method includes making a golf club head including a sole attached to a crown. The method further includes attaching a secondary plate to a face plate and attaching the face plate to the body.

BRIEF DESCRIPTION OF THE FIGURES

FIG. 7 is a close up view of a cross section of the golf club head of FIG. 1.

FIG. 8 is a side schematic view of a cross section of a golf club head having an alternative secondary plate.

FIG. 9 is a front schematic view of the golf club head of FIG. 8 with the alternative secondary plate shown in phantom.

FIG. 10 is an alternative embodiment of the secondary plate shown in phantom.

FIG. 11 is a close up view of a cross section of the golf club head of FIG. 8.

FIG. 12 is a close up view of the rear of a face plate, similar to FIG. 7, where the face plate includes a raised ring.

FIG. 13 is a close up view of the raised ring of the face plate shown in FIG. 12.

FIG. 14 is an alternative embodiment of a secondary plate shown in phantom.

DETAILED DESCRIPTION OF THE INVENTION

Figure 1:
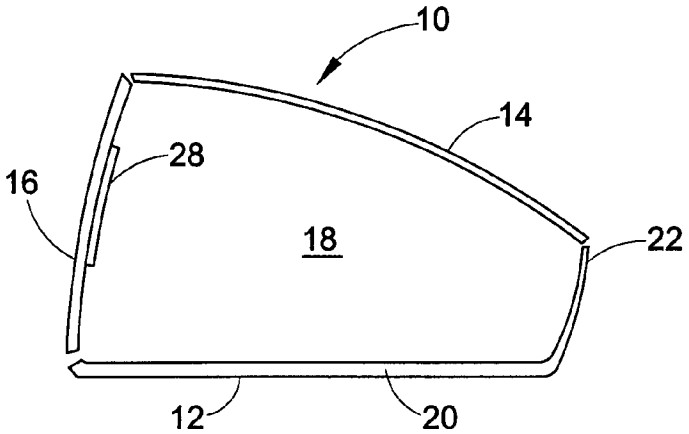
FIG. 1 is a side schematic view of a cross section of a golf club head having a secondary plate attached to a face plate.

With reference to FIG. 1 a golf club head 10 includes a body having a sole 12, a crown 14, and a face plate 16. The body defines a hollow interior 18. The sole 12 includes a generally horizontal portion 20 and an upwardly projecting skirt 22. The horizontal portion 20 preferably has a thickness ranging from about 0.020" to about 0.200". The thickness of the sole 12, including the horizontal portion 20, can be adjusted to accommodate weight adjustment and center of gravity alignment. The skirt 22 has a thickness that is usually thinner than that of the generally horizontal portion 20. The skirt also has a thickness ranging from about 0.020" to about 0.0485".

The crown 14 covers the top portion of the club head 10. The crown 14 can include a hosel portion to affix the club head to a shaft (not shown) and can also have a thickness ranging from about 0.020" to about 0.0485". The crown 14 and the sole 12, along with a heel 24, which is adjacent the hosel portion, and a toe 26, which is opposite the heel, define the hollow interior 18, which is covered in the front of the club by the face plate 16. The weight and center of gravity of the club head can be adjusted by adding weighted members to the body or by increasing the thickness of the crown 14, the sole 12, the heel 24 or the toe 26.

The face plate 16 includes the portion of the club head 10 that contacts the golf ball (not shown). The face plate 16 is generally made from a single piece of metal, which can include titanium, steel, a composite material or the like. Furthermore, the face plate 16 can be made of a forged metal. The face plate 16 fastens around its periphery to the crown 14 and the sole 12, the heel 24 and the toe 26. Preferably, the face plate 16 is welded to the crown 14, the sole 12, the heel 24 and the toe 26. The face plate 16 can have a thickness of about 0.085" to about 0.120". The face plate 16 can also attach inside its periphery. One such example would be where the club head body is formed in such a manner that an opening is provided in the central portion of the striking face for acceptance of the face plate.

Upon impact with a golf ball, the face plate 16 deflects slightly inwardly toward the hollow interior 18. This deflection results in a spring-like or trampoline effect imparted on the golf ball. Higher face plate deflection can be realized by using a thin face plate with materials, e.g., titanium, that have a low modulus of elasticity (Young's Modulus) or rigidity and high strength.

A stiffening plate or secondary plate 28 attaches to a rear side of the face plate 16. The secondary plate 28 can limit the deflection of the face plate 16, thus limiting the trampoline effect by increasing the effective rigidity of the face plate 16. Accordingly, the size and material from which the secondary plate 28 is made effects the deflection of the face plate. Alternatively, a plate can attach to the front side of the face plate 16 that can limit the deflection of the face plate. The extra or secondary plate may be a larger than the secondary plates disclosed in the figures.

Figure 2:
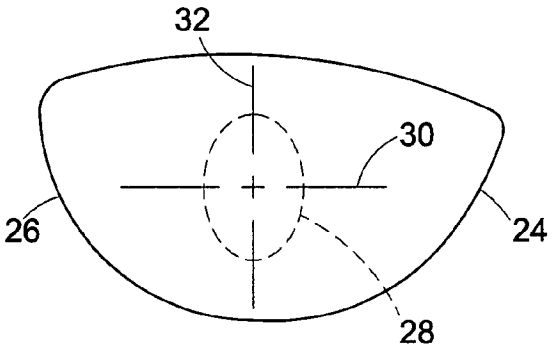
FIG. 2 is a front schematic view of the golf club head of FIG. 1 with the secondary plate shown in phantom.

With reference to FIG. 2, the secondary plate 28 can be circular. In this embodiment, the circular secondary plate 28 is centered along a horizontal axis 30 of the face plate 16 and a vertical axis 32 of the face plate. In one embodiment, the radius of the secondary plate 28 is 1.250"; however, the secondary plate 28 can be larger or smaller dependent upon the desired effect on the COR value of the club head.

Figure 3:
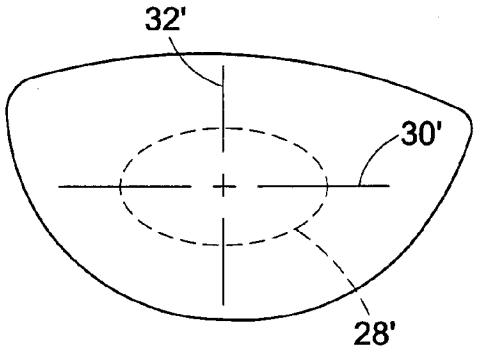
FIG. 3 is an alternative embodiment of the secondary plate shown in phantom.
Figure 5:
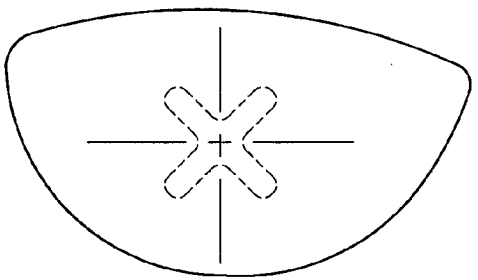
FIG. 5 is an alternative embodiment of the secondary plate shown in phantom.
Figure 6:
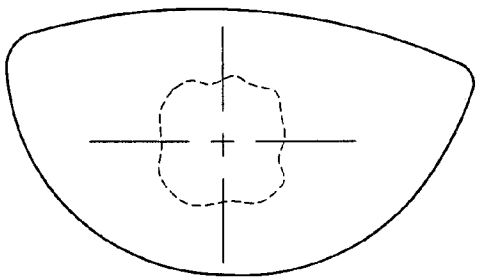
FIG. 6 is an alternative embodiment of the secondary plate shown in phantom.

With reference to FIG. 3, like components are identified by like numerals with a primed (') suffix. The secondary plate 28' can also be elliptical in configuration. In this embodiment, the elliptical secondary plate 28' is also centered along the horizontal axis 30' and the vertical axis 32' of the face plate 16. In this embodiment, the major axis of the secondary plate is 1.250" and the minor axis can be 0.625"; however, the secondary plate can take different dimensions as well. Furthermore, the secondary plate can take other configurations, such as square, rectangular, a cross (FIG. 4), an X (FIG. 5), a tee or a free-formed shape (FIG. 6).

The secondary plate 28 can have a thickness of about 0.020" to about 0.062". For ease of manufacture, the secondary plate 28 can be made from the same material as the face plate, or it can be made from a different material. The secondary plate 28 attaches to the face plate 16 around the periphery of the secondary plate. In one embodiment, the secondary plate 28 attaches by welds 34 (FIG. 7) to the face plate around its entire periphery of the secondary plate. Alternatively, the secondary plate 28 can attach to the face plate 16 intermittently around its periphery as well as at other locations, such as in the middle of the secondary plate. Moreover, the secondary plate 28 can attach to the face plate in other manners including fasteners, adhesives and the like.

As seen in both FIGS. 2 and 3, the periphery or outer edges of the secondary plate 28 are spaced from the crown 14, the sole 12, the heel 24 and the toe 26; nevertheless, the secondary plate can also be large enough such that an outer edge attaches to at least one of the crown, the sole, the toe or the heel.

The secondary plate 28 can have an area that is limited to the sweet spot of the face plate 16. The area of the secondary plate can be approximately ¼ to ⅓ of the surface area of the face plate, as is disclosed in FIGS. 2 and 3. A different sized secondary plate can be used where a different effect on the COR value is desired.

Figure 4:
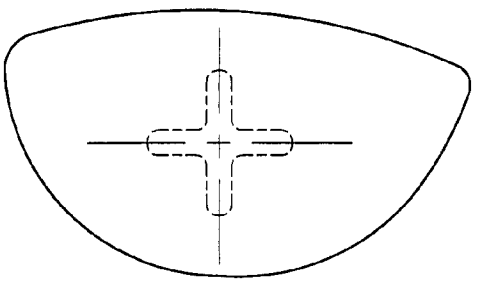
FIG. 4 is an alternative embodiment of the secondary plate shown in phantom.

With reference to FIG. 4, a gap 36 is developed between the face plate 16 and the secondary plate 28 when the secondary plate is fastened to the face plate. In one embodiment, the distance between the face plate 16 and the secondary plate 28 can range from about 0.010" to about 0.115". The gap allows the face plate 16 to deflect slightly before deformation stresses are introduced into the secondary plate 28, thus resulting in less deflection of the face plate. As seen in FIG. 4, the secondary plate can be substantially flat or linear in cross section. In alternative embodiments, the secondary plate 28 can have a slight curve to change the size of the gap 36. Likewise, in yet another alternative embodiment the secondary plate can lay flush against the face plate.

In yet another embodiment shown in FIGS. 8–11, an alternative secondary plate 124 includes an opening 134 through which a plug weld 136 attaches the secondary plate to the rear side of the face plate 16. The secondary plate 124 can be similar in size and configuration to the secondary plate 24 described with reference to FIGS. 1 and 2. The opening 134 is circular in this embodiment, however it can take other shapes such as rectangular, polygonal or a free-formed shaped. The opening 134 in this embodiment has a diameter of about 0.125" however, the opening 134 can be larger or smaller. The opening 134 is centered both in vertically and horizontally in the secondary plate 124 and the face plate 16, however the opening can be located elsewhere in the secondary plate and aligned elsewhere on the face plate. Furthermore, even though only one opening 134 is shown, the secondary plate can include a plurality of openings. Each opening can receive a weld, or only some of the openings can receive a weld. An example is shown in FIG. 14 where the secondary plate includes one or more openings inboard of the periphery of the secondary plate. The openings can take any number of shapes and can allow gasses to escape during the welding process.

The weld 136 attaches the secondary plate to the face plate, however other conventional fastening methods can be used, including an adhesive or a conventional fastener. The secondary plate 124' can also be elliptical as shown in FIG. 10, or be shaped as a cross, a tee, an X or a free form shape similar to the previous embodiment.

In yet another embodiment as shown in FIG. 12, a face plate 216 is formed to include a raised ring 238 that can approximate the shape of a secondary plate 228. In an alternative embodiment, the raised ring need not be formed in the face plate; the raised ring 238 can attach to the face plate. The raised ring 238 can have sloping or filleted edges to reduce stress on the face plate 216. The raised ring 238 can be used as filler material for welding the secondary plate 228 to the face plate 216. The raised ring 238 also serves as a location for weld beads 234 to reside and keeps the beads from coming in contact with the thin section of the face plate 216. It has been shown through testing that the defined edges of weld beads produce stress concentrations and may lead to cracking if in direct contact with the thinner sections of the face plate.

The secondary plate can also include a raised ring 242. The ring or thickened edge 242 can also serve as filler material during welding and separates the weld 234 from the thinner section of the secondary plate 228. Raised ring dimensions range from 0.020 to 0.200 thick and from 0.020 to 0.200 wide both on the face plate 216 and the secondary plate 228. The raised ring and thickened edges need not be continuous. The raised ring and the thickened edges can be used with the numerous different types of secondary plates described above.

The golf club has been described with reference to the preferred embodiments. Obviously, modifications and alterations will occur to others upon a reading and understanding of this specification without departing from the spirit and scope of the invention described herein. Dimensions and orientations have been given to more particularly describe the golf club head; however, the invention is not limited to only the dimensions disclosed. The invention is intended to include all modifications and alterations insofar as they come within the scope of the appended claims or the equivalents thereof.

The invention claimed is:

1. A golf club head comprising:

a sole;

a heel;

a toe;

a crown;

a face plate extending between the sole and the crown, the face plate including a front surface for contacting a golf ball; and a secondary plate for limiting the deflection of the face plate, the secondary plate being welded to a rear surface of the face plate at or adjacent an outer edge of the secondary plate such that the outer edge that is welded to the rear surface is spaced from at least one of the sole and the crown, wherein the secondary plate and the face plate define a gap between them, the gap being devoid of material for attaching the face plate to the sole.

2. The golf club head of claim 1, wherein the secondary plate is spaced from the sole and the crown.

3. The golf club head of claim 2, wherein the secondary plate is spaced from the heel and the toe.

4. The golf club head of claim 1, wherein the secondary plate is shaped as a circle, an ellipse, a cross, a tee or a free-form shape.

5. The golf club head of claim 1, wherein at least a substantial portion of the outer edge of the secondary plate is attached to the face plate.

6. The golf club head of claim 1, wherein the secondary plate is flat.

7. The golf club head of claim 1, wherein the secondary plate is curved.

8. The golf club head of claim 1, wherein the secondary plate is centered along the horizontal center of the face plate.

9. The golf club of claim 1, wherein the secondary plate is centered along the vertical center of the face plate.

10. The golf club head of claim 1, wherein the secondary plate includes an opening.

11. The golf club head of claim 1, wherein the surface area of the secondary plate is about one-quarter to about one-third the surface area of the face plate.

12. The golf club head of claim 1, wherein the face plate includes a ring and the secondary plate attaches to the ring.

13. The golf club head of claim 12, wherein the secondary plate includes a thickened edge attached to the ring.

14. The golf club head of claim 1, wherein the gap measures a distance between the face plate and the secondary plate in the range from about 0.010 inches to about 0.115 inches.

15. A golf club head comprising:

a sole;

a crown;

a face interposed between the sole and the crown; and a plate attached to a rear surface of the face and including an opening, wherein the plate attaches to the rear surface via a weld positioned within the opening and in contact with both the plate and the face, wherein the face and the plate define a gap between them.

16. The golf club head of claim 15, wherein the opening in the plate is aligned with a central vertical axis of the face.

17. The golf club head of claim 16, wherein the opening in the plate is aligned with a central horizontal axis of the face.

18. The golf club head of claim 15, wherein the opening is circular.

19. The golf club head of claim 15, wherein the plate includes a plurality of openings.

20. A golf club head comprising:

a sole;

a heel;

a toe;

a crown;

a face plate extending between the sole and the crown, the face plate including a front surface for contacting a golf ball; and a secondary plate for limiting the deflection of the face plate, the secondary plate being welded to a rear surface of the face plate at or adjacent an outer edge of the secondary plate such that the outer edge that is welded to the rear surface is spaced from at least one of the sole and the crown, wherein the secondary plate and the face plate define a gap between them, and wherein the entire outer edge of the secondary plate is attached to the face plate.

21. The golf club of claim 20, wherein the face and the secondary plate define a gap between them, the gap measuring a distance between the face plate and the secondary plate in the range from about 0.010 inches to about 0.115 inches and being devoid of material for attaching the face plate to the sole.

22. The golf club of claim 21, wherein the surface area of the secondary plate is about one-quarter to about one-third the surface area of the face plate.

* * * * *